United States Patent [19]

Lee

[11] Patent Number: 4,848,461

[45] Date of Patent: Jul. 18, 1989

[54] METHOD OF EVALUATING FRACTURING FLUID PERFORMANCE IN SUBSURFACE FRACTURING OPERATIONS

[75] Inventor: Wellington S. Lee, Duncan, Okla.

[73] Assignee: Halliburton Company, Duncan, Okla.

[21] Appl. No.: 211,310

[22] Filed: Jun. 24, 1988

[51] Int. Cl.[4] ..... E21B 43/26; E21B 47/06; E21B 49/00

[52] U.S. Cl. ..... 166/250; 73/155; 166/308

[58] Field of Search ..... 166/250, 308; 72/151, 72/155

[56] References Cited

U.S. PATENT DOCUMENTS

| | | | |
|---|---|---|---|
| 3,948,325 | 4/1976 | Winston et al. | 166/308 |
| 4,398,416 | 8/1983 | Nolte | 166/250 X |
| 4,442,897 | 4/1984 | Crowell | 166/308 X |
| 4,478,282 | 10/1984 | Nolte et al. | 166/308 X |
| 4,534,870 | 8/1985 | Williams | 166/283 X |
| 4,749,038 | 6/1988 | Shelley | 166/250 |

*Primary Examiner*—Stephen J. Novosad

*Attorney, Agent, or Firm*—Arnold, White & Durkee

[57] ABSTRACT

The invention provides a method for determining parameters of a formation and of a subsurface fracturing operation in response to the rheology of the fracturing fluid used to fracture the formation. Preferably, the fluid efficiency will be determined from pressure decline data. This established fluid efficiency will then be functionally related with indices representative of the fluid behavior and fluid consistency to determine a dimension of the created fracture. This dimension may then be utilized to determine the fluid loss coefficient of the fracturing fluid in the formation, which may then be utilized in designing a full scale fracturing treatment with provent.

10 Claims, No Drawings

METHOD OF EVALUATING FRACTURING FLUID PERFORMANCE IN SUBSURFACE FRACTURING OPERATIONS

BACKGROUND OF THE INVENTION

The present invention relates generally to improved methods for evaluating subsurface fracture parameters in conjunction with the hydraulic fracturing of subsurface formations, and more specifically relates to improved methods for utilizing test fracture operations and analysis, commonly known as "mini-frac" operations, to design formation fracturing programs.

Mini-frac operations consist of performing small scale fracturing operations utilizing a small quantity of fluid to create a test fracture and to determine pressure decline data of the formation. Mini-frac operations are performed using little or no proppant in the fracturing fluid. After the formation is fractured, the well is shut in and the pressure decline of the formation is observed over time. The data thus obtained is used in a fracture model to determine parameters to be used to design the full scale formation fracturing treatment.

Mini-frac test operations are significantly different from conventional full scale fracturing operations. For example, as discussed above, only a small amount of fracturing fluid is injected (for example, as little as 25 barrels), and no proppant is typically utilized. The desired result is not a propped formation fracture of practical value, but a small scale, short duration, fracture, to facilitate collection of pressure decline data in the formation. This pressure decline data will facilitate estimation of formation and fracture parameters.

For example, the pressure decline data will be utilized to calculate the effective fluid loss coefficient, the fracture width and fracture length, the fracture fluid efficiency and the observed closure time. These parameters will then be utilized in a fracture design system to design the full scale fracturing operation. Accurate knowledge of the fluid leak-off coefficient is of major importance in designing a fracturing operation. If the leak-off coefficient is estimated too low, there is a substantial likelihood of a sand-out. Conversely, if the fluid leak-off coefficient is estimated too high, too great a fluid pad volume will be utilized, thus resulting in significantly increased costs to the fracturing operation. Additionally in this circumstance, the use of fluid loss additives in the fracturing fluid to help counteract the effects of a estimated high leak-off coefficient will not only be costly, but may often cause damage to the formations.

Conventional methods of mini-frac analysis have required reliance upon assumptions of questionable validity. Conventional mini-frac analysis techniques have assumed that the width of a mini-frac test fracture is proportional to the pressure drop from the instantaneous shut-in pressure to the formation closure pressure. However, the mechanical properties of the fracturing fluid will have substantial impact upon the fracture dimensions. For example, a "thin", or relatively non-viscous, fracturing fluid will yield a long, narrow fracture; while a "thick", or relatively viscous, fracturing fluid, under the same conditions, will yield a fracture of significantly decreased length and increased width.

The mechanical properties of fracturing fluids can be expressed in known terminology in terms of a "fluid behavior index", and a "fluid consistency index". Conventional techniques of mini-frac analysis have failed to consider the rheology of the fluid, and have thus been unsuited to yielding optimal data regarding the mini-frac test fracture, leading to less than optimal data of the formation characteristics.

Accordingly, the present invention produces a new method for mini-frac analysis of formations and for designing subsurface of fracturing operations in response to the fracturing fluid rheology.

SUMMARY OF THE INVENTION

Methods in accordance with the present invention facilitate determination of formation fracture parameters, and of fracturing operation parameters in response to the rheology of the fracturing fluid. In accordance with the present invention, the pressure decline data of a fracturing operation of the formation in question will be obtained through a conventional mini-frac operation. The pressure decline data will preferably include conventional determinations of the formation closure pressure and the formation closure time. Additionally, characteristics of the fracturing fluid will be determined, such as by conventional laboratory testing.

The observed pressure decline data is utilized to determine parameters representative of the fluid loss into the formation during mini-frac operation. Preferably, the fluid loss parameters will be functionally representative of the ratio of the fluid lost into formation after shut-in to the fluid lost into the formation during pumping. Such fluid loss parameters can, of course, actually be utilized in another form, such as the ratio of the total fluid loss from the beginning of pumping to closure time to the total fluid loss during pumping, etc. In this particularly preferred embodiment, the fluid loss parameters will then be utilized to determine the fluid efficiency of the formation. Subsequently, the determined fluid efficiency and the determined fluid rheology parameters will be functionally related in an energy balance relation to determine a dimension of the created fracture, preferably the fracture length. From the known fluid efficiency, and the determined fracture dimension, the fluid loss coefficient (the "leak-off coefficient") of the formation may be determined for use in designing the full-scale fracturing operation.

DETAILED DESCRIPTION OF A PREFERRED EMBODIMENT

As noted above, methods in accordance with the present invention allow the designing of a formation fracturing operation in response to rheological properties of the fracturing fluid. This is preferably accomplished through use of a mini-frac analysis performed through use of an energy balance relation. This energy balance relation yields a fluid loss coefficient of the formation in question which is dependent upon the rheological properties of the fracturing fluid and which, is thus, optimally representative of the fluid and fracture performance during a fracturing operation. Several analytical variations are available depending upon the fracture model to be utilized. The disclosed mini-frac analysis techniques are suitable for application with well-known fracture geometry models, such as the Christonovich-Zheltov model, the Perkins-Kern model and the Penny model.

In a preferred implementation, the fracturing operation parameters, formation parameters and fracturing fluid parameters not empirically determined will be determined mathematically, through use of an appropriately programmed computer. Those skilled in the art will recognize, however, that the method of the present invention may also be adapted to be performed through use of a "type-curve matching" process, the fundamental mechanics of which are well known in the art. The mini-frac analysis will preferably be based upon field-observed closure time. Although "curve matching" methods of analysis may be utilized, the field-observed closure time method has shown itself to be more accurate, and is preferred.

In accordance with the present invention, the formation data will be obtained from the mini-frac test fracturing operation. This test fracturing operation may be performed in a conventional manner to provide the closure pressure and closure time of the formation. As is well known in the art, the formation closure pressure may be determined by a pump-in/flow back test. Plotting the results of the test on a pressure decline vs. square root of time plot will also yield the formation closure time.

Once the formation closure time and formation closure pressure have been determined, a pressure decline function, $G_N$ at the closure time may be determined. The pressure decline function represents the theoretical pressure decline after shut-in, assuming ideal leak-off characteristics. The pressure decline function ($G_N$), may be determined for a plurality of fluid efficiencies, for example, $G_{\frac{1}{2}}$ or $G_{\frac{2}{3}}$. Of these two, $G_{\frac{2}{3}}$ will be representative of a higher fluid efficiency, and, under most circumstances is preferred. In most circumstances, the choice of $G_{\frac{1}{2}}$ or $G_{\frac{2}{3}}$ will not cause a dramatic variance in the fluid loss coefficient which is ultimately determined. $G_{\frac{1}{2}}$ and $G_{\frac{2}{3}}$ may each be determined from the following relations:

$$G_{1/2} = \frac{2}{\pi}\left[\frac{\sin^{-1}\sqrt{\delta_1}}{\delta_1} + \sqrt{\delta}\right] - 1 \tag{1}$$

$$G_{2/3} = \frac{3}{7}\pi\frac{\Gamma\left(\frac{2}{3}\right)}{\Gamma\left(\frac{7}{6}\right)} - \frac{3}{2}\delta_1^{2/3} - \frac{3}{10}\delta_1^{5/3} - \frac{1}{2}\sum_{n=2}^{\infty}\prod_{r=1}^{n-1}(2r-1)\frac{\delta_1^{n+2/3}}{(n+2/3)n!2^{n-1}} \tag{2}$$

For $\delta \geqq 1/2$ $$G_{2/3} = \frac{3}{2}\delta_2^{1/2}(1-\delta_1^{2/3}) - \frac{1}{3}\delta_2^{2/3} - \sum_{n=2}^{\infty}\prod_{r=1}^{n-1}(3r-2)\frac{\delta_2^{n+1/2}}{(2n+1)n!3^{n-1}} \tag{3}$$

For $\delta \leqq 1/2$ where n and r represent the number of factors in a series; and $$\delta = \frac{t - t_p}{t_p} \tag{4}$$

-continued $$\delta_1 = \frac{t_p}{t} \tag{5}$$

$$\delta_2 = \frac{t - t_p}{t} \tag{6}$$

t represents the time since start of pumping, in minutes and $t_p$ represents the pumping time, in minutes.

Once the pressure decline function ($G_N$) has been determined for the selected high or low fluid efficiency, the ratio of the fluid loss during pumping ($V_{LP}$) to the fluid loss after shut-in ($V_{LS}$) may be determined. This ratio is functionally related to the pressure decline function as follows:

$$\frac{1}{G_N} = \frac{V_{LP}}{V_{LS}}$$

The fluid loss during pumping ($V_{LP}$) and the fluid loss after shut-in ($V_{LS}$) can also be expressed as a function of the fluid efficiency ($\mu$), the injection rate of the fluid at the wellbore(Q) and the pumping time ($t_p$):

$$V_{LP} = (1-\mu)Qt_p \tag{8}$$

and $$V_{LS} = (\mu)Qt_p \tag{9}$$

Accordingly, the pressure decline function ($G_N$), and the ratio of the fluid loss during pumping to the fluid loss after shut-in may be expressed in terms of fluid efficiency:

$$\frac{1}{G_N} = \frac{V_{LP}}{V_{LS}} = \frac{1-\mu}{\mu} \tag{10}$$

Thus, by virtue of the determined pressure decline function ($G_N$) the fluid efficiency ($\mu$) is known and may be utilized to determine fracture dimensions, preferably the fracture length. The relations expressed in equations 1–10 are conventional relations known to those skilled in the art. Determination of these relations is described in SPE Publication 16916, entitled "Study of the Effects of Fluid Rheology on Minifrac Analysis" by W. S. Lee (the inventor of the present application), published by the Society of Petroleum Engineers. Although this publication discloses methods in accordance with the present invention, it also discloses the state of the art, and is therefore incorporated herein by reference to demonstrate the state of the art. Similarly, SPE Publication No. 17151, entitled "Fracture Propagation Theory and Pressure Decline Analysis With Lagrangian Formulation for Penny-Shaped and Perkins Kern Geometry Models" by W. S. Lee; and Society of Petroleum Engineers and Department of Energy Publication SPE/DOE 13872, entitled "Pressure Decline Analysis With the Christianovich and Zeltov and Penny-Shaped Geometry Model Fracturing" also by W. S. Lee, each additionally discloses methods in accordance with the present invention as well as the state of the art. These publications are incorporated herein by reference to demonstrate the state of the art.

Conventionally, the fracture volume ($V_c$) is assumed to be proportional to the pressure difference between the instantaneous shut-in pressure and the formation closure pressure.

However, the present invention discards this assumption, which is believed to be highly erroneous in at least some applications. In accordance with the present invention, the fracture length will be determined by an energy balance relation which considers the fluid properties of the fracturing fluid as follows:

$$E - \frac{V_o}{\beta}\int_0^1 \frac{\partial p}{\partial x} L_D f(L_D)\, dL_D = \frac{K\gamma}{2L_f^3}\left(\frac{V_o}{\beta}\right)^2 \quad (11)$$

where:

E represents the separations energy associated with the surface tension and plastic deformation of the reservoir rock, as is known to those skilled in the art.

$\beta$ is a shape function represented in the two dimensional geometry model utilized by the value of $\pi/4$.

$L_D$ is dimensionless distance defined as the ratio of $L/L_f$ at point L.

$L_f$ is the created fracture half length.

$f(L_D)$ is a shape function representative of the two dimensional fracture model utilized.

$V_o$ represents the half-wing created volume divided by the gross fracture height.

K represents the elastic constant which may be determined by relations as set forth in equation 14 below.

$\gamma$ represents a shape constant indicative of the relationship between the pressure and the shape of the fracture, which may be determined by analysis of the change in width of the fracture to the length of the fracture. An exemplary deviation for this shape constant ($\gamma$) is known to the art. An exemplary deviation is disclosed in SPE Publication No. 11067, entitled "A Two Dimensional Theory of Fracture Propagation," Published by the Society of Petroleum Engineers (1982). The disclosure of this publication is incorporated herein by reference to demonstrate the state of the art.

and $\partial p/\partial x$ represents the pressure gradient at location x in the fracture.

Equation 11 represents the energy balance relation in a general form. This general form relation may be rewritten for specific two-dimensional fracture models. For example, for the Perkins-Kern fracturing model, the energy balance relation may be written as follows:

$$E - \pi L_f b_f/2 \int_0^1 \frac{\partial p}{\partial L} L_D f_p(L_D)\, dL_D = K_H b_f^2/H \quad (12)$$

where $L_D$ represents the dimensionless distance defined as ratio of $L/L_f$ at point L.

p represents the fluid pressure at distance L.

$f_p(L_D)$ represents the shape function defined as:

$$f_p(L_D) = (1 - L_D)^{\frac{1}{2}}$$

$b_f$ represents the created maximum half-width at the wellbore at the end of pumping.

H represents the fracture height.

and $K_H$ is a parameter defined as:

$$K_H = y/2(1 - \nu^2)$$

where y represents Young's modulus and where $\nu$ represents Poisson's ratio.

Similarly, the energy balance may be expressed in a form suitable for use with the Penny-shaped fracture geometry model. In terms of the Penny model, the energy balance relation may be expressed as follows:

$$E - 2R_f b_f \int_0^1 \frac{\partial p}{\partial r} R_D^2 f(R_D)\, dR_D = K b_f^2/R_f \quad (13)$$

where:

$R_f$ represents the created fracture radius at the end of pumping r represents the radius at a point on the fracture surface $R_D$ represents the dimensionless radius defined as the ratio of the radius at a point (r) and the maximum radius to the wellbore ($R_f$).

$f(R_D)$ is a shape function defined as:

$$\sqrt{1 - R_D^2}$$

and $$K = \pi Y/4(1 - \nu^2) \quad (14)$$

where Y = Young's Modulus.

Uniquely, the resolution of the energy balance relation is performed in response to the fluid behavior index (n') and the fluid consistency index (K') of the fracturing fluid, thereby evaluating the fracture performance relative to the rheology of the fracturing fluid.

Referring first to the expression of the energy balance equation in terms of the Perkins-Kern geometry model, the pressure gradient in the length dimension ($\partial p/\partial L$) is functionally representative of the fluid behavior index (n') and the fluid consistency index (K'), and to the flow rate per unit height ($q_t$), as may be seen from the relation:

$$\frac{\partial p}{\partial L} = C_p q_t^{n'} \quad (15)$$

where:

$C_p$ a parameter which relates the pressure gradient to the flow rate per unit height ($q_t$); which may be expressed as a function of the fluid rheology indices of K' and n':

$$C_p = K' \frac{2^{1+n'}(2n' + 1)^{n'}}{n'^{n'}\, b_{av}^{2n'+1}} \quad (16)$$

where:

$b_{av}$ represents the average width at distance L.

and:

$q_t$ (the flow rate at distance L per unit heigth) is expressed by the relation:

$$q_t = \pi((L_f b_f + b_f L_f)\, F_p(L_D) + b_f L_D f_p(L_D) L_f)/6 + q_1 \quad (17)$$

$$= \eta Q(f_p(L_D)(1 - L_D/6) + 7(1 - \eta)\, g_{2/3}(L_D)/6\eta)/2 \quad (18)$$

where:

$\mu$ represents the fluid efficiency, as determined from equation 10.

$F_p(L_D)$ represents a shape function defined as:

$$F_p(L_D) = \int_{L_D}^{1} f_p(L_D)dL_D - 4(1 - L_D)^{5/4}/5 \quad (19)$$

Q represents the average pumping rate during pumping;

and $q_1$ represents the fluid loss per unit height in the constant height model.

By sustituting the above relations into the Perkins-Kern model expression of the energy balance relation, as expressed in Equation 12, and by substituting and rearranging, the relation may be expressed as:

$$E + K_3 L_D^{2n'+1} \int_0^1 f_p(L_D)^{2n'}(f_p(L_D)(1 - L_D/6) + 7 + (1 - \eta)\, g_{2/3} f_p(L_D)/6\eta)^{n'} L_D dL_D = K_4 L_f^{-2} \quad (20)$$

where $$K_3 = \frac{(2n' + 1)^{n'}\, 2^{6n'+1}\, (H/\eta Q)^{n'}}{n'^{n'}\, (5t_p)^{2n'}\, K'} \quad (21)$$

and $$K_4 = \frac{25Y(\eta Q t_p/H^2)}{32\pi^2\,(1 - \nu^2)\, H} \quad (22)$$

The energy balance relation of Equation 13 may then be resolved for only one unknown, the created fracture length ($L_f$) of one wing of the fracture.

The fracturing fluid may be analyzed through conventional laboratory techniques to determine characteristics to establish the indices of K' and n'. For example, of the following:

$$\dot{\epsilon} = K'\tau^{1/n'} \quad (23)$$

$\dot{\epsilon}$, the shear rate in non-Newtonian fluid; $\tau$, the shear stress in non-Newtonian fluid; and n' may be empiricly determined at simulated temperatures and pressures through use of a Fann viscometer, model 50, through techniques known to those skilled in the art. The parameters will preferably be determined at generally appropriate temperatures and pressures which can emulate those expected to be encountered during the formation fracturing operation.

Referring back to Equation 13, therein is expressed the energy balance relation for the Penny-shaped formation model. In Equation 13 the fluid rheology parameters (n' and K') are expressed in the pressure gradient in the radial direction ($\partial p/\partial r$):

$$\partial p/\partial r = C(q_t/r)^{n'} \quad (24)$$

where:

C is a parameter which relates the pressure gradient to the flow rate per unit height ($q_t$) which may be expressed as follows:

$$C = K' \frac{2^{1+n'}\,(2n' + 1)^{n'}}{n'^{n'}\, b^{2n'+1}} \quad (25)$$

wherein:

b represents the maximum width at radius r.

After substituting and rearranging, the energy balance relation for the Penny Model may be restated and solved for the fracture radius ($R_f$). Those skilled in the art will recognize that the pressure decline function ($G_N$) equal to $G_{\frac{1}{2}}$ and $G_{\frac{2}{3}}$ will be expressed in half values, $G_{\frac{1}{4}}$ and $G_{\frac{1}{3}}$, respectively. The restated relation is as follows:

$$E + K_1 R_D^{3n'+1} \int_0^1 R_D^{2-n'} f(R_D)^{-2n'} ((1 - R_D^2)^{1/2} + 7(1 - \eta) g_{1/3}(R_D)/6\eta)^{n'} dR_D = K_2 R_f^{-5} \quad (26)$$

where:

$$K_1 = \frac{(2n' + 1)^{n'}\, 2^{2n'+1}\, \pi^{n'}}{n'^{n'}\, (3t_p)^{2n'}\, (\eta Q)^{n'}} \quad (27)$$

and $$K_2 = \frac{9Y\,(\eta Q t_p)^2}{64\,(1 - \nu^2)} \quad (28)$$

The fracture radius ($R_f$) can then be utilized to determine the fluid leak-off coefficient of the formation in a conventional manner.

As can be seen from the above description, the method of the present invention may be adapted for use with any of the conventional two-dimensional fracture models. Once the fracture dimensions in question (preferably the fracture length or radius, as described herein), is determined through use of the novel mini-frac analysis of the present invention, the fracture dimension, as well as the fluid efficiency and the determined leak-off coefficient may be utilized in a conventional fracture design program to design the full-scale fracture treatment, including the pad volume, proppant schedule, etc.

Many modifications and variations may be made in the techniques described and illustrated herein without departing from the spirit and scope of the present invention. Accordingly, it should be readily understood that the methods and embodiments described and illustrated herein are illustrative only and are not to be considered as limitations upon the scope of the present invention.

What is claimed is:

1. A method of determining parameters of a full scale fracture treatment of a subterranean formation comprising the steps of:

(a) injecting fluid into a wellbore penetrating said formation to generate a fracture in said formation;

(b) measuring the pressure of the fluid in said fracture over time wherein said pressure changes after termination of said fluid injection;

(c) determining at least one parameter of a two dimensional fracture geometry model from the change in pressure measured in step (b) using an energy balance relationship which includes a pressure gradient term defined using measured rheological parameters.

(d) calculating fracture half width; and (e) predicting fluid volume required for a full scale fracture treatment using parameters determined in steps (c) and (d).

2. The method of claim 1 wherein said fluid is selected from the group aqueous fluids, hydrocarbon fluids and mixtures thereof, which are suitable for fracturing.

3. The method of claim 2 wherein said fluid contains a gas selected from the group comprising nitrogen and carbon dioxide.

4. The method of claim 1 wherein said measured rheological parameters of step (c) are the fluid behavior index, n', and the fluid consistency index, k'.

5. A method of determining parameters of a full scale fracturing treatment of a subterranean formation comprising the steps of:

(a) injecting fluid into a wellbore penetrating said formation to generate a fracture in said formation;

(b) measuring the pressure of the fluid in said fracture over time wherein said pressure declines after termination of said fluid injection;

(c) determining the fracture closure pressure and the fracture closure time from the pressure decline data;

(d) determining the pressure decline function at the fracture closure time which represents the theoretical pressure decline after termination of said fluid injection;

(e) determining the ratio of said fluid loss during injection to said fluid loss after termination of injection;

(f) determining the efficiency of said fluid from the pressure decline function and the ratio of fluid loss during injection to fluid loss after termination of injection;

(g) calculating a fracture half length using an energy balance relationship which includes the fluid efficiency calculated in step (c) and a pressure gradient term defined using measured rheological parameters of said fluid;

(h) calculating fracture half width using a two dimensional fracture geometry model;

(i) determining the effective fluid loss coefficient for said fluid; and (j) predicting fluid volumes required for a full scale fracturing treatment using said fluid loss coefficient in a fracture design program.

6. The method of claim 5 wherein said fluid is selected from the group comprising aqueous fluid, hydrocarbon fluids and mixture thereof which are suitable for fracturing.

7. The method of claim 5 wherein the fracture closure time of step (c) is determined from a plot of pressure decline versus square root of time.

8. The method of claim 5 wherein the pressure decline function of step (d) assumes a fluid efficiency selected from the group comprising high, low and ideal efficiency.

9. The method of claim 5 wherein said measured rheological parameters of step (f) are the fluid behavior index, n', and the fluid consistency index, k'.

10. The method of claim 5 wherein said energy balance relationship is solved for the fracture half length ($L_f$) and represented by the formula:

$$E - \beta \int_{0}^{Vo} \frac{1}{\delta x} \frac{\delta p}{L_D f(L_D)} dL_D = \frac{K\gamma}{2} \frac{V_o^2}{L_f \beta}$$

where E is the separation energy, Vo is the half wing created volume divided by the gross fracture height, $\beta$ and $f(L_D)$ are shape functions representative of a two dimensional fracture geometry model, $$\frac{\delta p}{\delta x}$$

is the pressure gradient term, $L_D$ is dimensionless distance defined as the ratio $L/L_f$ at point L, K is an elastic constant, $\delta$ is a shape constant indicative of the relationship between the pressure and the shape of the fracture, $L_f$ is the fracture half length.

* * * * *